US005503235A

United States Patent [19]

Falgout, Sr.

[11] Patent Number: 5,503,235

[45] Date of Patent: Apr. 2, 1996

[54] DIRECTIONAL DRILLING CONTROL METHOD

[76] Inventor: Thomas E. Falgout, Sr., 110 Charles Read St., Lafayette, La. 70503

[21] Appl. No.: 345,896

[22] Filed: Nov. 28, 1994

[51] Int. Cl.[6] ..... E21B 7/04

[52] U.S. Cl. ..... 175/61; 175/74; 175/107; 175/325.2

[58] Field of Search ..... 175/61, 73–75, 175/101, 107, 325.2

[56] References Cited

U.S. PATENT DOCUMENTS

| | | | |
|---|---|---|---|
| Re. 29,526 | 1/1978 | Jeter | 175/61 X |
| 3,896,667 | 7/1975 | Jeter | 73/151 |
| 4,286,676 | 9/1981 | Nguyen et al. | 175/74 |
| 4,596,294 | 6/1986 | Russell | 175/317 X |
| 4,834,196 | 5/1989 | Falgout, Sr. | 175/74 |
| 4,895,214 | 1/1990 | Schoeffler | 175/38 |
| 5,117,927 | 6/1992 | Askew | 175/325.2 X |
| 5,259,467 | 11/1993 | Schoeffler | 175/38 |
| 5,368,111 | 11/1994 | Benoit et al. | 175/256 X |

*Primary Examiner*—Roger J. Schoeppel
*Attorney, Agent, or Firm*—John D. Jeter

[57] ABSTRACT

A method for causing a drill string to progressively deflect at preselected length intervals in proportion to the rate of flow therethrough allowing the drill string to follow a resulting curved well bore is described. The drill string utilizes a plurality of axially spaced deflection subs each of which responds to preselected manipulations of the rate of fluid flow therethrough to deflect its center line. Flow control signals at the surface describe when the deflection of particular subs become activated.

19 Claims, 3 Drawing Sheets

DIRECTIONAL DRILLING CONTROL METHOD

This invention pertains to methods for bending the axes of drill string elements, each in turn, as they reach the point of selected departure of the well bore from the preceding well bore direction during the hole deepening process. Deflectable drill string elements in axially spaced relationships are caused to deflect, or bend, by selective manipulation of the drilling fluid flow controls at the surface encoded to activate particular elements in selected order as the influenced elements reach a particular location in the well being drilled or serviced.

BACKGROUND OF THE INVENTION

In the past drill string elements were assembled at the surface to include bent subs and the like and, when installed in a well, were manipulated down hole to accomplish the desired effect. The down hole assembly was withdrawn from the well to make adjustments or element changes after one effect was achieved to prepare for the well course controls to follow and the drill string was again installed in the well. These round trips were costly in time and resources.

More recently slightly bent drill string elements were used, in conjunction with down hole drilling motors, to deflect the progressing well bore then the drill string was rotated during subsequent drilling activity to nullify the effect of the bent element for further well bore direction control. This strained the lower assembly of the drill string but the result was sustainable and accepted in light of the economies realized.

Still more recently, drill string elements have been supplied which respond to signals from the surface to change the down hole assembly between straight and directional drilling configurations. The lower portion of a drill string is commonly quite stiff compared to the upper portion due to the use of drill collars between the bit and the upper drill string portion. The well bore could be deflected at a rate too severe for the stiffer portions of the drill string to follow through unless they are made part of a flexible assembly. My copending U.S. patent application Ser, No. 267,563 represents a bendable element of this type.

There is a long standing need for methods to actuate bendable drill string elements as they approach the point of aggressive well bore deflection without negating the effects of those elements below that are already deflected so that a general curvature of the stiffer portions of the drill string results to negotiate the deflected well bore.

It is therefore an object of this invention to provide methods to utilize bendable drill string elements and down link commands from the surface to bend those elements in succession as drilling processes bring them to selected locations in the well to form a generally curved down hole assembly to fit the curvature of the well bore being deflected.

It is another object of this invention to provide methods to manipulate bendable drill string elements by combining elements that respond individually to selected drilling fluid flow rate encoding at the surface.

It is still another object of this invention to provide bendable drill string elements that can be controlled from the surface to bend individually to negotiate well bore curves and by further individual manipulation, controllable from the surface, to straighten again once through the bore curve.

It is still another object of this invention to provide bendable drill string elements that can be individually bent to negotiate a well bore curved in a first plane, straighten out after negotiating the curve, and again be deflected to form or to follow a well bore curved in a plane different from the plane of the first curve.

These and other objects, advantages, and features of this invention will be apparent to those skilled in the art from a consideration of this specification, including the attached claims and appended drawings.

From the foregoing, it will be seen that this invention is one well adapted to attain all of the ends and objects hereinabove set forth, together with other advantages which are obvious and which are inherent to the method.

SUMMARY OF THE INVENTION

For descriptive convenience, down link command is defined as the actions at the surface to convey messages down the drill string to direct responsive actions of the down hole assembly. In this case, the messages are conveyed by drilling equipment essential to the normal drilling activity by manipulation of controls common to such activity.

A first bendable sub is, preferably, part of a drilling motor body. At least one bendable sub is spaced some distance upward of the motor body. All bendable elements individually respond to particular drilling fluid flow control manipulations that do not influence other bendable elements such that each can be caused to deflect at times selected by the driller at the surface.

A first bendable sub responds to a first drilling fluid flow rate, maintained for a preselected amount of time, to actuate to change from a straight configuration to a bent configuration. The first sub will remain straight during drilling if the drilling fluid flow rate is promptly established above the first flow rate.

A second bendable sub is situated farther up the drill string, usually just above the motor. This sub will respond to a second drilling fluid flow rate, maintained for a second preselected amount of time, to change from a straight to a bent configuration. The second flow rate is, preferably, set higher than the first flow rate, by conditions established when the sub is assembled. The process can be repeated with additional, axially spaced, bendable subs.

The procedure for bending the first sub, and not bending the second sub is to start the first flow rate to bend the first sub then promptly raise the flow rate to the drilling rate which is higher than both first and second flow rates. When the hole has deepened to bring the upper sub to the departure point the fluid flow rate is reduced to the second flow rate, which is too high to influence the first sub, hold that rate until the second sub deflects then raise the flow rate to the drilling rate. Both subs are then deflected. A third sub still higher in the drill string can be similarly deflected if it actuates at a higher flow rate than the first two subs without influencing those subs.

To selectively straightening the individual subs after the well bore curve is achieved, for drilling straight ahead on the now changed direction, the mud circulation is stopped to allow all bendable subs to straighten out. If necessary, a brief reverse circulation excursion assures the straightening process. The mud flow is again started and hastened through the responsive flow ranges of subs to remain straight, holding the flow rate within the responsive ranges of the subs to be deflected until they individually react, then drilling ahead at a flow rate to which no sub reacts.

Presented herein, also, is a sub form that responds to increase in the drilling fluid flow between selected amounts to change the configuration between the straight and deflected options each time the increase is experienced. That option allows at least one sub to be added to the string that responds to an alternate surface control sequence. It is most useful to straighten the drill string after the lower end has negotiated a curved well bore for what is often called the reach of the extending well bore after deflection.

The result is a generally curved drill string between the plurality of bendable subs involved, and actuated. The drill string above the stiffer lower assembly will generally follow through the curved well bore with no ill effects.

It is essential that the bending of each sub in succession place the deflected drill string center line in about the same plane. This rotational alignment is made simple by inclusion of the rotational orienting sub of my copending U.S. patent application Ser. No. 270,760 between bendable subs. That sub permits orientation of drill string elements separated by threaded connections.

A rotator motor, responsive to particular manipulation of the drilling fluid flow rate, included between bendable elements makes it possible to create or follow a well bore curved in one plane, straighten the string or progressing well bore and again deflect the drill string to curve within a new plane different from the old plane. A rotator of that nature is represented by the U.S. Pat. No. 45,259,467 issued Nov. 9, 1993. That Patent by reference is made part of this application.

BRIEF DESCRIPTION OF DRAWINGS

In the drawings, wherein like features have the same captions.

DETAILED DESCRIPTION OF DRAWINGS

Figure 1:
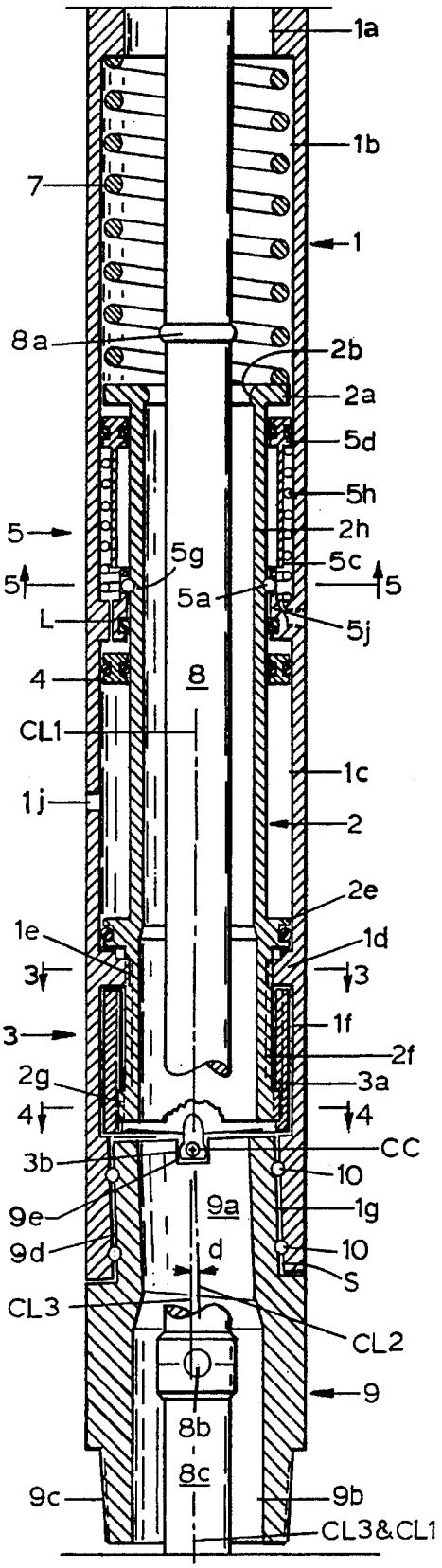
FIG. 1 is a longitudinal section of the preferred embodiment in the straight configuration.

The drawings and descriptive matter presented below are from my copending U.S. patent application Ser. No. 267,563 to illustrate means to practice the claims herein and in no way are intended to represent limitations. Other apparatus capable of accomplishing similar ends may be used and are anticipated by and are within the scope of the claims.

In the drawings certain features, well established in the art and not bearing upon points of novelty have been omitted in the interest of clarity and descriptive efficiency. Such features may include weld lines, threaded fasteners, and threaded connections between some associated parts.

Figure 2:
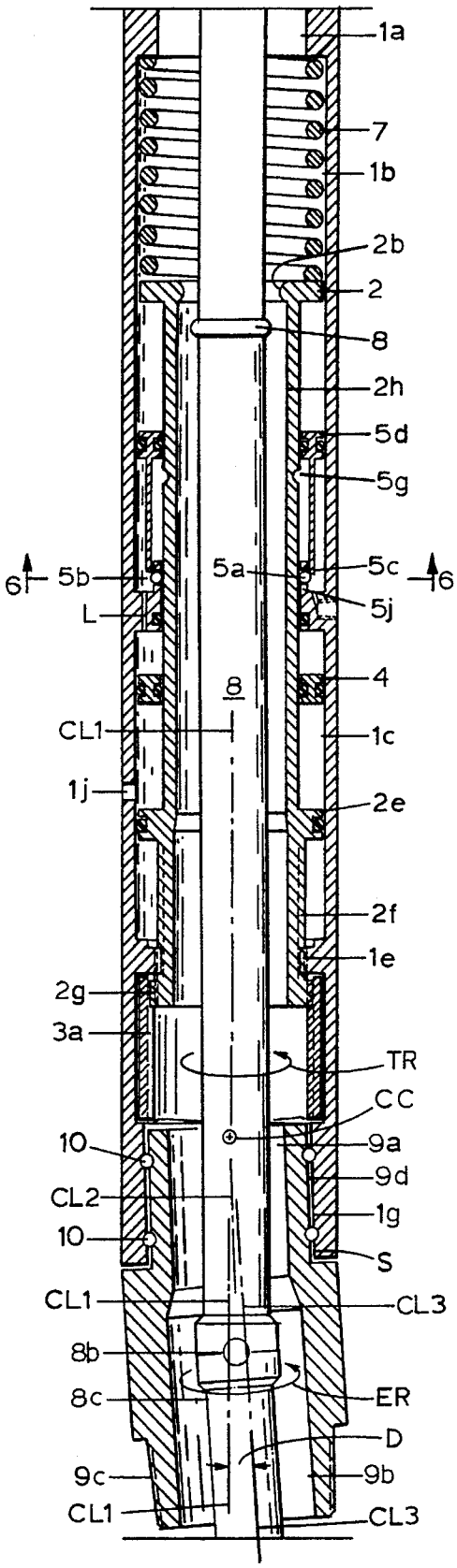
FIG. 2 is a section similar to FIG. 1 but actuated to the deflected configuration.

FIGS. 1 and 2 are side views, mostly cut away, of the preferred embodiment in the straight and deflected configurations respectively. The body comprised of body portion 1 and body extension 9 with the associated fluid channels comprises a length of drill string. The lower tool joint 9*c* attaches with fluid tightness to a downwardly continuing portion of a drill string. A similar upper tool joint is not shown but is, preferably, quite similar to the 9*c* version and attaches with fluid tightness to an upwardly continuing portion of a drill string. If the apparatus is part of a drilling motor body, the motor drive shaft 8 passes along the central channel as shown.

Deflection is achieved by rotation of extension 9 relative to the portion 1 about center line CL2 which is tilted relative to the longitudinal axis CL1 of portion 1 and axis CL3 of the extension 9. Extension 9 is rotated by turret 3 by way of tang 3*b* in socket 9*e*. Turret 3 is rotated by spiral spline 3*a* in cooperation with drive spline 2*g* which is moved axially by mud pressure and retained rotationally by spline 2*f* in cooperation with drive spline 1*e*. The spline system is shown enlarged in FIGS. 3 and 4.

Assembly 2 is effectively a wash pipe and differential piston integrated into a spiral splined linear to rotary movement converter. All of assembly 2 is exposed to essentially the same pressure except the region sealed against portion 1 at two different diameters by piston 2*e* and gland flange 5*j*. The differential piston force can be multiplied by axially spaced repeats of the flange and piston arrangement, with added ports 1*j*, to provide tandem power cylinders. Assembly 2, turret 3 and related splines comprise a hydraulic motor. A mud pressure difference between the general mud channel 9*a* and the annulus outside the enclosure urges piston 2*e* toward opening 1*j*. When mud pressure rises enough for piston 2*e* to overcome spring 7, the assembly 2 moves upward rotating turret 3 in the process. Turret 3 has tang 3*b* in socket 9*e* to compel sympathetic rotation of extension 9. Extension 9 rotates about deflected center line CL2. This center line has about the same angle between CL1 and CL3, the latter two, in the FIG. 1 configuration, being effectively coaxial. The center line CL2 is shown to be deflected two degrees from CL1 and CL3. When extension 9 is rotated one-half turn, the deflections are cumulative and CL3 is then deflected four degrees from CL1. The angles between center lines is a designers option.

When drilling fluid (mud) pressure is reduced below a preselected value spring 7 overcomes piston 2*e* and assembly 2 moves downward, rotating turret 3 and extension 9 back to the straight configuration of FIG. 1. By choice of direction of spiral 3*a* the recovery direction of rotation of extension 9 can be counter clockwise viewed from the top end. With that arrangement the drill string normal rotation will assist recovery due to well bore wall drag below axis CL2.

All pistons shown are positively sealed in the drawing and in practice. The closure between portion 1 and extension 9 may be related to a motor body downstream of the power producing motor. Sealing there may be by labyrinth or it may be positively sealed and is captioned S to indicate some degree of closure.

Drive shaft 8 will be present if the use is in a motor body. Some motors have shafts that do not stay concentric with the body and must be free to oscillate within a bore. Flex joint 8*b* is symbolically shown and is accommodated within opening 9*b*. Some motor shafts merely strain to accept the oscillating displacement and axis deflection, if present. The accommodating bore is anticipated by the claims but the shaft itself is not part of this invention. The bulge 8*a* will be explained later as part of an optional signal valve but that use is a matter of convenience, when present, as a valve element support member suspended within the body portion.

Optional features include a signal valve to cause a pressure pulse in the mud stream when assembly 2 moves, to actuate the apparatus to the deflected state, and bulge 8*a* passes through orifice 2*b*. That is a resistance change, not a valve closure, and the bulge 8*a* does not have to be concentric with orifice 2*b*. A brief pressure change in the mud stream at the surface is detectable to indicate actuation.

Optional also is a timer feature that permits drilling in the straight configuration by locking assembly 2 before sufficient pressure is applied to move piston 2*e*. Annular pistons 4 and 5*d* provide an oil filled annular enclosure. When mud pressure exists in opening 1*b*, higher than that at port 1*j*, the two pistons 4 and 5*d* are urged to move downward at a rate permitted by preselected leak L. Spring 5*h* urges piston 5*d* upward to flange 2*a* when there is no mud flow. A mud flow too low to overcome spring 7 will overcome spring 5*h*. Spring 5*h* is omitted from FIG. 2 in the interest of clarity of that area of the drawing. Given time, lock skirt 5*c* will engage balls 5*a* and restrain them in groove 5*g* and no greater pressure can move assembly 2 upward and drilling fluid flow rate can be established without apparatus deflection. If mud pressure is initiated more rapidly, assembly 2 will start moving and urge balls 5*a* outward in radial bores 5*b* before the lock has time to actuate. When lock skirt 5*c* arrives at the lock balls, they block further movement of the skirt and no locking action takes place. Drilling then proceeds in the deflected state until mud pressure is reduced below a preselected amount.

Figure 3:
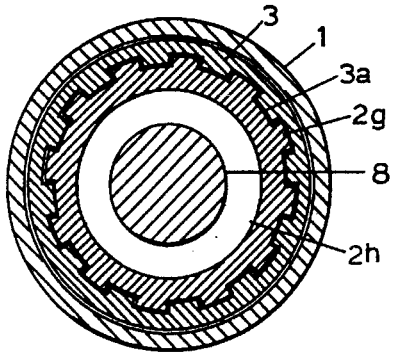
FIG. 3 is a cross section, somewhat enlarged, taken along line 3—3.
Figure 4:
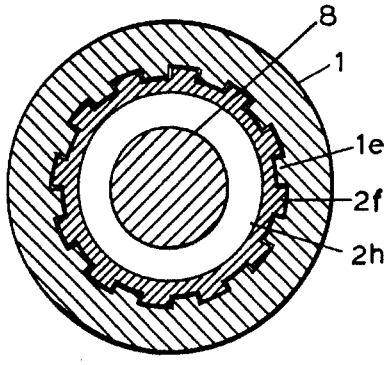
FIG. 4 is a cross section, somewhat enlarged, taken along line 4—4.

FIGS. 3 and 4 more clearly show the linear to rotary conversion means. To function, spline pair 3*a* and 2*g* and pair 1*e* and 2*f* need only to differ in helical pitch. By preference, pair 2*f* and 1*e* are straight, or axial, to avoid rotating piston 2*e*. No motor shaft is shown in bore 2*h*.

Figure 5:
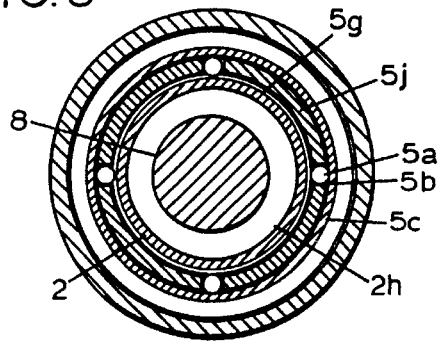
FIG. 5 is a cross section, somewhat enlarged, taken along line 5—5.
Figure 6:
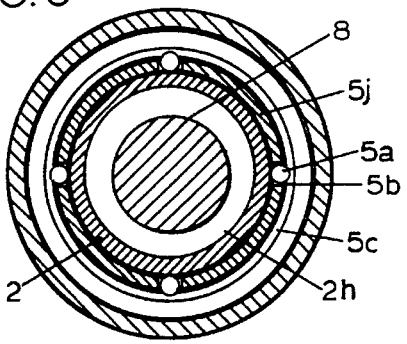
FIG. 6 is a cross section somewhat enlarged, taken along line 6—6.

FIGS. 5 and 6 show more detail of the optional lock 5. FIG. 5 differs from the line 5—5 condition of FIG. 1 in that piston 5*d* has just begun to move down in FIG. 1 and skirt 5*c* has not reached the locked position over the balls 5*a*. FIG. 5 shows the skirt moved to lock the balls into groove 5*g* and to inhibit upward movement of assembly 2, disabling the deflection means.

Figure 7:
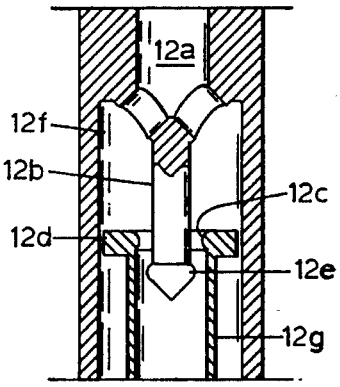
FIG. 7 is a symbolic longitudinal section representing an area of FIG. 1 with an alternate feature.

FIG. 7 represents a symbolic replacement for the feature 8*a* if the sub is used above a drilling motor where no shaft 8 exists. Assembly 12*g* may be identical to assembly 2. Flange 12*d* and orifice 12*c* serve the function of elements 2*a* and 2*b* already described. Support 12*b* is suspended in opening 12*f* to position enlargement 12*e* such that it passes through orifice 12*c* to produce a drilling fluid pressure pulse when assembly 12*g* moves upward, as previously described, to actuate the sub to the deflected configuration.

Figure 8:
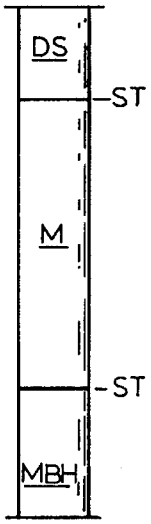
FIGS. 8, 9, and 10 are side elevations of a drill string length representing operational options presented by the sub when used both above and within a drilling motor body.
Figure 9:
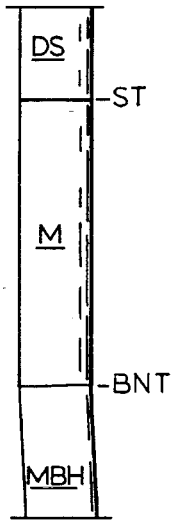
Figure 10:
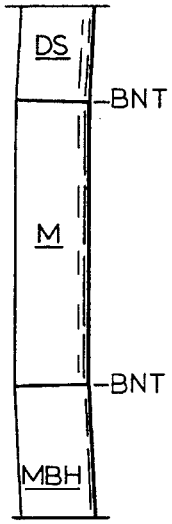
Figure 11:
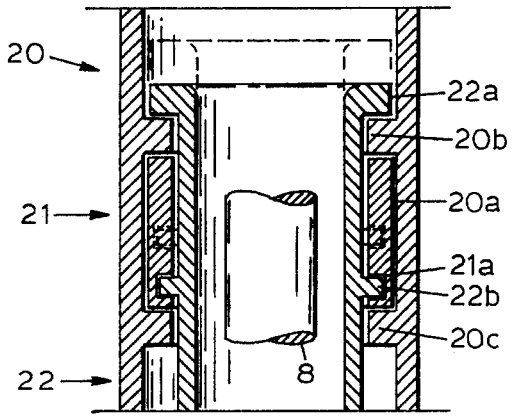
FIGS. 11, and 12 are side views, in cut away, of a selected area of FIGS. 1 and 2 respectively with an alternate form of selective controls.
Figure 12:
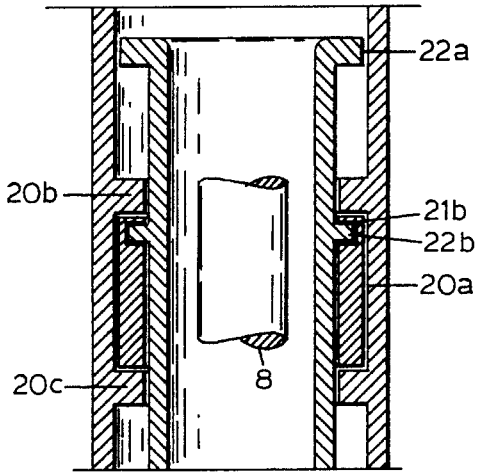
Figure 13:
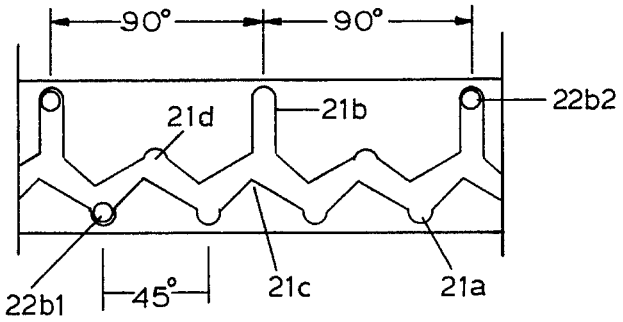
FIG. 13 is a surface development of part of the structure of FIGS. 11 and 12. In the drawings wherein like features have similar captions.

Description of FIGS. 8,9, and 10 will be deferred until FIGS. 11, 12, and 13 have been explained.

FIGS. 11 and 12 show only the area of the sub to be altered to utilize a turnstile control of the deflection feature. Body portion 20 has bore 20*a* to accept turnstile 21 between axial constraints 20*b* and 20*c*. Assembly 22 has cam pins 22*b* projecting to engage a serpentine groove, see FIG. 13, to rotate the turnstile one increment each time the assembly makes an up and down excursion. As shown in FIG. 13 the groove has peripherally spaced lodges typified by 21*a* occupied by pins 22*b* when the assembly 22 is in the down, or no-flow, position. In that position the pin is labeled 22*b*1. When the pin moves from an extreme position it engages a skewed wedge limit on the groove typical of 21*c* and is directed always in the same rotational direction which causes the turnstile to rotate. If the pin next arrives in lodge 21*d* on the next upward movement the pin and assembly is stopped before deflection takes place and drilling can continue in the straight configuration. On the next down and up excursion the pin enters elongated groove lodge 21*b* and the assembly can move up to change to the deflected configuration. The operation can be repeated endlessly and one such position for the pin is labeled 22*b*2. Two pins are shown but a greater number is preferred on larger subs.

No spring is shown above flange 22*a*. Reverse circulation of drilling mud can be used briefly to force the assembly down to straighten the sub. No signal valve is shown but may be added to this assembly as previously described for FIGS. 1, and 2, or 7. There is normally a drag applied to the turnstile to prevent vibration wear. No drag is shown but it is normally an o-ring in a seal type groove about the periphery of the turnstile.

FIGS. 8, 9, and 10 show the deflection states available if the deflection sub is situated between a drill string DS and a drilling motor M and between the drilling motor M and the motors bearing housing MBH. FIGS. 1 and 2, as shown, represent the sub between motor M (portion 1) and the housing MBH (extension 9). Similarly, if portion 1 is directly connected to the drill string above the motor and extension 9 is directly connected to the top of motor housing M the principal difference is the absence of shaft 8 which can be replaced, optionally, by support 12*b* of FIG. 7. The drilling options available are the straight configuration of FIG. 8, bent motor housing only of FIG. 9, and both drill string bent and motor housing bent of FIG. 10. The resulting generally curved stiffer down hole assembly can negotiate a greater rate of deflection of a well bore that a more flexible upwardly continuing drill string can follow through. The lock timer 5 is responsive to a drilling fluid flow rate established for each sub by its respective spring 5*h* and the sub above the motor can respond to a flow rate greater than that which actuates the lower sub. The turnstile and timer combination can also be used to the same end. The tandem sub arrangement can then be actuated, in either case, in sequence as the down hole assembly proceeds through the point of well bore deflection.

Figure 14:
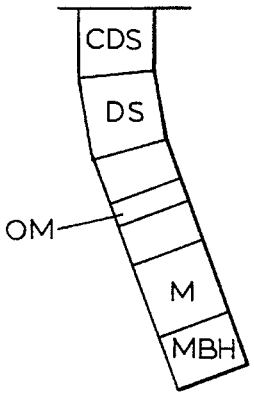
FIGS. 14, and 15 are similar to FIGS. 8 through 10 and represent manipulations continuing from those shown in FIG. 10.

FIG. 14 shows conditions subsequent to those of FIG. 10 in that the continuing drill string CDS above the DS component of FIG. 10 has now entered the curved bore and the bendable sub within the motor body between M and MBH has been straightened. This arrangement may be accomplished by reducing the drilling fluid flow rate until all dendable subs are released from the deflected state and tend to revert to the straight condition. The fluid flow rate is then increased directly through the flow rate region to which the motor body deflects causing the body to remain straight. As the flow rate is increased it is maintained some time in the response region of each sub to be bent and, finally, operational flow rates are resumed. An orienting motor OM is shown in the assembly but not yet activated. Orienting motors rotate the drill string below them relative to the drill string above, usually less than one turn per actuation. Such orienting motors are available for use on coiled tubing. One such motor is represented by the U.S. Pat. No. 5,259,467 issued Nov. 9, 1993 to Schoeffler. That motor responds to drilling fluid flow controls and is compatible with the subs defined herein.

Figure 15:
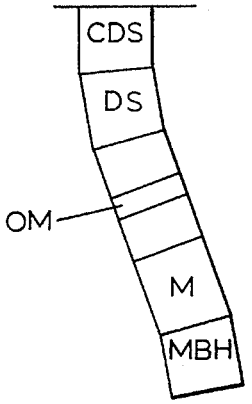

In FIG. 15 orienting motor OM has been rotated one half turn and the sub in the drilling motor body has been deflected. Such manipulations are shown for descriptive convenience. The drilling circumstance would likely dictate other actions. The placement of the orienting motor and nature of deflection subs chosen provide a wide range of options within the scope of the claims.

From the foregoing, it will be seen that this invention is one well adapted to attain all of the ends and objects hereinabove set forth, together with other advantages which are obvious and which are inherent to the tool.

It will be understood that certain features and sub combinations are of utility and may be employed without reference to other features and sub-combinations. This is contemplated by and is within the scope of the claims.

As many possible embodiments may be made of the method of this invention without departing from the scope thereof, it is to be understood that all matter herein set forth or shown in the accompanying drawings is to be interpreted as illustrative and not in a limiting sense.

The invention having been described, I claim:

1. A method for pipe string operations in deflected well bores to cause a lower end assembly of a fluid conducting pipe string to become curved to negotiate a curved well bore, the method comprising the steps of:

a) assembling the lower pipe string assembly with axially spaced deflection subs that respond to preselected manipulations proportional to the rate of fluid flow along the pipe bore to actuate to deflect the pipe string center line, each sub to respond to said manipulations of a peculiar characteristic related to that particular sub without actuating other subs; and b) providing said peculiar characteristics as each said particular sub is to be actuated.

2. The method of claim 1 wherein at least one of said subs is part of a drilling motor body.

3. The method of claim 1 wherein at least one of said subs is responsive to drilling fluid flow rates in which said peculiar characteristics comprise the establishing if said flow rate is within a preselected flow rate range and maintaining that rate for a preselected period of time.

4. The method of claim 1 wherein the drill string comprises at least one additional sub that is responsive to said manipulations with said peculiar characteristics comprising an increase in said drilling fluid flow rate between preselected amounts to change between straight and deflected configuration each time said increase is sensed by said additional sub.

5. The method of claim 1, wherein at least one of said subs provides a signal detectable at the surface to indicate that the sub has responded to said peculiar characteristics.

6. The method of claim 5 wherein said signal comprises a brief change in resistance to flow of fluid through said pipe string to provide a brief increase in standpipe pressure at the surface.

7. The method of claim 1 wherein at least one of said subs responds to a second preselected, manipulation of said fluid flow to release itself from said deflected state.

8. The method of claim 7 wherein said second preselected manipulation of said fluid flow comprises the reduction of said fluid flow to a rate below a preselected amount.

9. The method of claim 1 wherein an orienting motor is included in said assembly to change the rotational relationship between drill string elements above relative to drill string elements below it in response to third preselected manipulations of said fluid flow rate peculiar to said orienting motor.

10. A method for drill string operations in well bores being drilled to cause a progressing well bore to be deflected and to cause the drill string to deflect at selected length intervals to allow the drill string to follow through the resulting curved well bore as the bore is produced, the method comprising the steps of:

a) assembling a lower drill string assembly with a plurality of axially spaced deflection subs that respond to preselected manipulations proportional to the rate of fluid flow through the drill string bore to deflect its center line, each said sub to respond to said manipulations of a peculiar characteristic related to that sub to actuate to deflect the center line of said drill string; and b) providing said preselected manipulations with surface fluid flow controls to provide said peculiar characteristics when particular subs are to be actuated.

11. The method of claim 10 wherein an orienting motor is included in said assembly to change the rotational relationship between drill string elements above relative to drill string elements below it in response to third preselected manipulations of said fluid flow rate peculiar to said orienting motor.

12. The method of claim 10 wherein the drill string comprises at least one additional sub that is responsive to said manipulations with said peculiar characteristics comprising an increase in said drilling fluid flow rate between preselected amounts to change between straight and deflected configuration each time said increase is sensed by the sub.

13. The method of claim 10 wherein at least one of said subs provides a signal detectable at the surface to indicate that the sub has responded to said peculiar characteristics.

14. The method of claim 13 wherein said signal comprises a brief change in resistance to flow of fluid through said pipe string to provide a brief increase in standpipe pressure at the surface.

15. The method of claim 10 wherein at least one of said subs responds to a second preselected manipulation of said fluid flow to release itself from said deflected state.

16. The method of claim 15 wherein said second preselected manipulation of said fluid flow comprises the reduction of said fluid flow to a rate below a preselected amount.

17. The method of claim 15 wherein said subs are actuated to reshape the lower drill string assembly, after having served in the deflected configuration, comprising the additional steps of:

a) providing said second preselected manipulation to cause said subs to be released from said deflected state;

b) increasing said flow of fluid to traverse the response ranges of subs not to be deflected in less time than required for those subs to respond and retaining said rate of said flow of fluid in the response range of each sub to be deflected until that sub responds; and c) changing the rate of fluid flow to an operational amount to which no said sub responds.

18. The method of claim 10 wherein at least one of said subs is part of a drilling motor body.

19. The method of claim 10 wherein at least one said sub is responsive to drilling fluid flow rates in which said peculiar characteristics comprise the establishing of said flow rate within a preselected flow rate range and maintaining that rate for a preselected period of time.

* * * * *